US007509068B2

(12) United States Patent
Honma

(10) Patent No.: US 7,509,068 B2
(45) Date of Patent: Mar. 24, 2009

(54) IMAGE FORMING APPARATUS

(75) Inventor: Mikimasa Honma, Akishima (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 220 days.

(21) Appl. No.: 11/705,098

(22) Filed: Feb. 12, 2007

(65) Prior Publication Data

US 2008/0019727 A1 Jan. 24, 2008

(30) Foreign Application Priority Data

Jul. 20, 2006 (JP) ..... 2006-197811

(51) Int. Cl.
*G03G 15/00* (2006.01)

(52) U.S. Cl. ..... 399/82; 399/401

(58) Field of Classification Search ..... 399/38, 399/75, 76, 82, 361, 401; 271/265.01, 265.02
See application file for complete search history.

(56) References Cited

U.S. PATENT DOCUMENTS

| | | | | |
|---|---|---|---|---|
| 5,725,211 | A * | 3/1998 | Blanchard et al. | 271/265.02 |
| 7,177,585 | B2 * | 2/2007 | Matsuzaka et al. | 399/394 |
| 7,327,963 | B2 * | 2/2008 | Funabiki | 399/15 |
| 2004/0136733 | A1 * | 7/2004 | Kretschmann et al. | 399/16 |
| 2005/0286922 | A1 * | 12/2005 | Oki | 399/75 |

FOREIGN PATENT DOCUMENTS

| | | |
|---|---|---|
| JP | 02-146618 | 6/1990 |
| JP | 10-320344 | 12/1998 |
| JP | 11-085426 | 3/1999 |
| JP | 11-237768 | 8/1999 |
| JP | 2000-305324 | 11/2000 |
| JP | 2001-337801 | 12/2001 |
| JP | 2003-241931 | 8/2003 |

OTHER PUBLICATIONS

Japanese Office Action dated Jul. 3, 2008.

* cited by examiner

*Primary Examiner*—Hoan H Tran
(74) *Attorney, Agent, or Firm*—Finnegan, Henderson, Farabow, Garrett & Dunner, L.L.P.

(57) ABSTRACT

An image forming apparatus that forms an image on a front side of a sheet then reverses the sheet front and back sides and forms an image on the back side, including: a sheet conveying path; a sheet edge portion detection sensor; a sheet reference mark detection sensor; a first determination section for determination of a position of an image to be formed on the back side, referring to a detected edge of the sheet; a second determination section for determination of a position of an image to be formed on the back side, referring to a detected reference mark; and switching section for switching whether to use the first determination section or the second determination section for determination of the position of the image to be formed on the back side of the sheet, based on setting information on double-sided printing to be performed by the image forming apparatus.

6 Claims, 8 Drawing Sheets

IMAGE FORMING APPARATUS

This application is based on Japanese Patent Application No. 2006-197811 filed on Jul. 20, 2006 in Japanese Patent Office, the entire content of which is hereby incorporated by reference.

FIELD OF THE INVENTION

The present invention relates to an image forming apparatus that forms an image on a front side of a sheet, and then reverses the front and back sides of the sheet to form an image on the back side.

BACKGROUND OF THE INVENTION

In recent years, the prevailing are image forming devices, such as copiers and printers, that enable double sided printing by forming an image on a front side of a sheet, and then reversing the front and back sides of the sheet. to form an image on the back side. Users have various demands on printings for which such image forming devices performs double sided printing. FIG. 8 shows diagrams of a sheet S having been subjected to double-sided printing, wherein the diagram on the left side in FIG. 8 shows the image on the front side, and the diagram on the right side shows the image on the back side. The area inside the dashed lines in FIG. 8 is the image area, and the position of the image on the front side with respect to the image on the back side is shown G in FIG. 8. For a double-sided printing sheet S, as shown in FIG. 8, there is a demand that an image on the front side and an image on the back side be formed at the same position (X in FIG. 8) relative to the same edge of the sheet. Particularly, printing industries, where strict conditions regarding printings are imposed, have a strong requirement.

In this situation, there are proposed technologies of superposing the positions of an image on the front side and an image on the back side of a sheet to be subjected to double-sided printing. According to the technology disclosed in Patent Document 1 (Japanese Patent Publication TOKKAI No. H11-237768), when an image is to be recorded on the front side of a recording medium, the relation between the trailing edge position of a recording sheet and the position of image recording is detected, the position being in the conveying direction of the recording medium; when an image is to be recorded on the back side of the recording medium, the leading edge position of the recording medium in the conveying direction is detected; and an image recording position of the back side of the recording sheet is set, based on a thus detected signal. Further, according to the technology disclosed in Patent Document 2 (Japanese Patent Publication TOKKAI No. 2000-305324), dedicated positioning marks are formed in a margin of a sheet material having been subjected to a fixing process; the marks are read with a CCD line sensor in case of forming an image on the back side; and position adjustment of the image on the back side is performed.

However, with the technology disclosed in Patent Document 1, thermal shrinkage is caused when a recording sheet having an image recorded on the front side passes through the fixing device. Accordingly, even when an image is recorded on the back side with reference to the position of the leading edge of the recording sheet in the conveying direction, it may occur that the image on the front side and the image on the back side are formed at different positions from the same edge.

With the technology disclosed in Patent Document 2, dedicated positioning marks are formed on a sheet. Accordingly, even if marks are formed of yellow toner, which is obscure, an image which is not requested by the user is formed, which is not preferable.

Therefore, in accordance with the present invention, there is provides an image forming apparatus that superposes an image on the front side and an image on the back side by a suitable method, based on setting information on double-sided printing.

To achieve at least one of the abovementioned objects, an image forming apparatus reflecting one aspect of the present invention forms an image on a front side of a sheet, then reverses the sheet front and back sides, and forms an image on the back side of the sheet, and comprises:

a conveying path for conveying the sheet;

an edge portion detection sensor which detects an edge of the sheet being conveyed through the conveying path, the edge portion detection sensor provided on the conveying path;

a mark detection sensor which detects a reference mark formed on the sheet being conveyed through the conveying path, the mark detection sensor provided on the conveying path;

a first determination section which determines a position of an image to be formed on the back side of the sheet, referring to the edge of the sheet detected by the edge portion detection sensor;

a second determination section which determines a position of an image to be formed on the back side of the sheet, referring to the reference mark detected by the mark detection sensor; and a switching section which switches whether to use the first determination section or the second determination section for determination of the position of the image to be formed on the back side of the sheet, based on setting information on double-sided printing to be performed by the image forming apparatus.

DETAILED DESCRIPTION OF THE PREFERRED EMBODIMENT

An image forming apparatus in an embodiment in accordance with the present invention will be described below.

Figure 1:
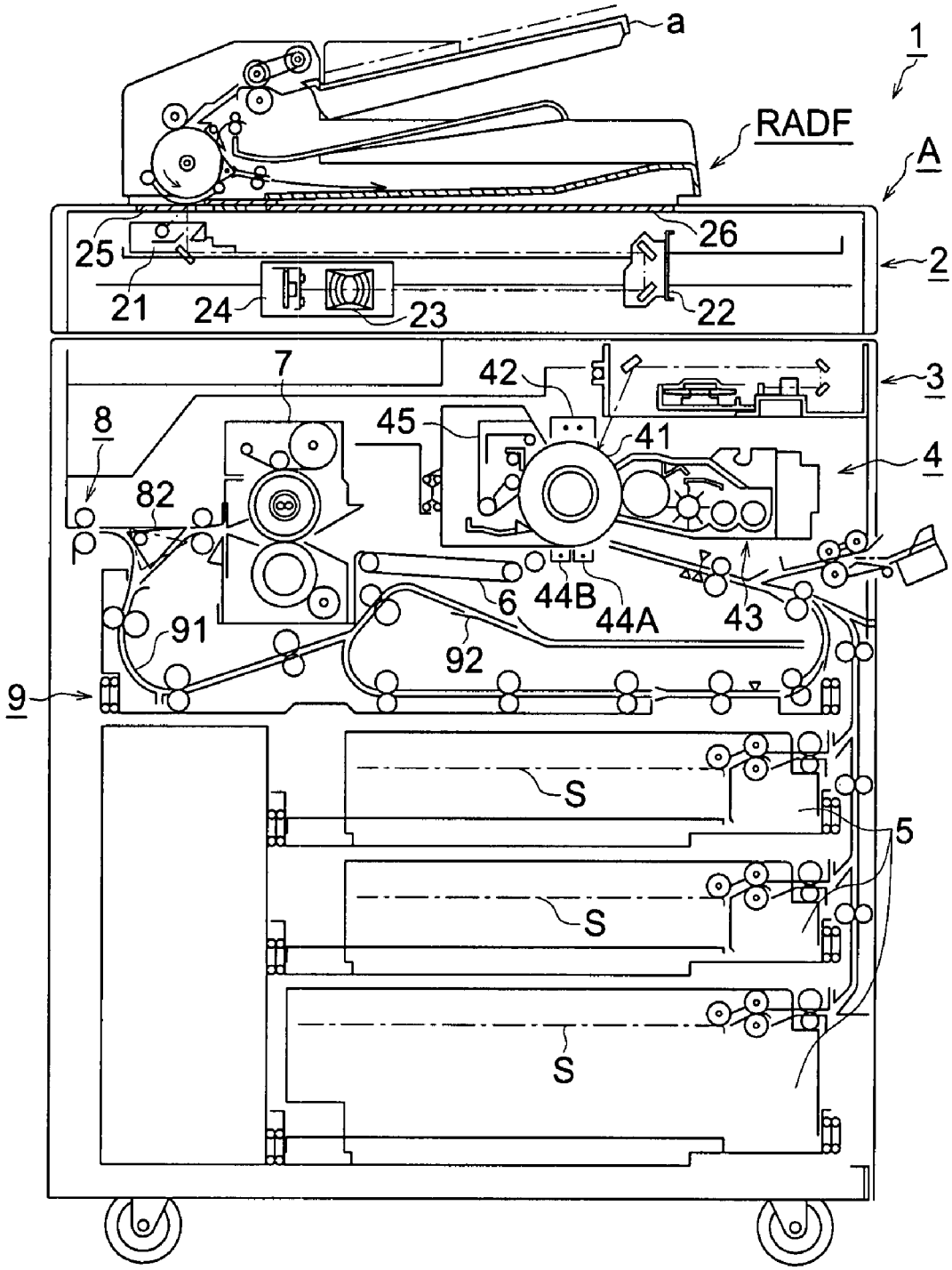
FIG. 1 is a diagram showing the entire structure of an image forming apparatus in accordance with the invention.

FIG. 1 is a diagram showing the entire structure of an image forming apparatus in accordance with the invention.

An image forming apparatus 1 is constructed with a reverse automatic document feeder RADF and a main body section A.

The reverse automatic document feeder RADF is disposed on the top of the main body section A and can be opened and closed with respect to the main body section A. An original document sheet having been set on a document feeding table 'a' is conveyed by various rollers toward an image reading section 2.

The main body section A is constructed with the image reading section 2, an exposure section 3, image forming section 4, sheet storage section 5, conveying section 6, fixing section 7, sheet ejection section 8, re-conveying section 9, etc.

The optical system of the image reading section 2 is constructed with an exposure unit 21 provided with a light source and a first mirror, V mirror unit 22 provided with a second and third mirrors, lens 23, CCD image sensor 24, and the like. Reading operation of an original document sheet conveyed by the reverse automatic document feeder RADF is performed in a state where the exposure unit 21 is located below a slit exposure glass 25. Reading operation of an original document sheet loaded on a document table glass 26 is performed such that the exposure unit 21 and the V mirror unit 22 move.

An image of an original document sheet read by the image reading section 2 is subjected to image processing, and the image-processed data is stored in a RAM.

Now, a process of image forming on a sheet S will be described.

The photoreceptor 41 is driven by a main motor (not shown), the surface of the photoreceptor 41 is supplied with power from a power source (not shown) and charged to the positive polarity by a discharge of a charger 42 (+800 V in the present embodiment). Then, the photoreceptor 41 is exposed by the exposure section 3, corresponding to image information, and an electrostatic latent image is formed on the photoreceptor 41. When the formed electrostatic latent image passes through a developer 43, toner charged to the positive polarity is adhered to the latent image by applying positive polarity developing bias in the developer 43, and thus a toner image is formed on the photoreceptor 41. The formed toner image is transferred from the photoreceptor 41 to a sheet S by a transferer 44A, and the sheet S is separated by a separator 44B. Toner remaining on the photoreceptor 41 after transfer is cleaned off by a cleaning section 45. The separated sheet S is conveyed to the fixing section 7 having a pair of a heating roller and pressing roller. As a result, the tone image is fixed to the sheet S, and the sheet S with an image formed thereon is ejected outside the apparatus by the sheet ejection section 8.

In a case of double-sided printing, a sheet S with an image formed on which front side is conveyed to a conveying path 91 in a re-conveying section 9 by a conveying path switching plate 82, and is switched back by a reversing section 92 to be reversed the front and back sides. Then, the sheet S is again conveyed to the image forming section 4, subjected to image forming on the back side, and ejected outside the apparatus by the sheet ejection section 8.

Herein, the image forming apparatus 1 in the present embodiment forms a monochrome image by an electrophotographic method. However, an image forming apparatus in accordance with the invention is not limited to the present embodiment, and may be a color image forming apparatus, of course. Also, the image forming method may be any one other than electrophotographic methods.

Figure 2:
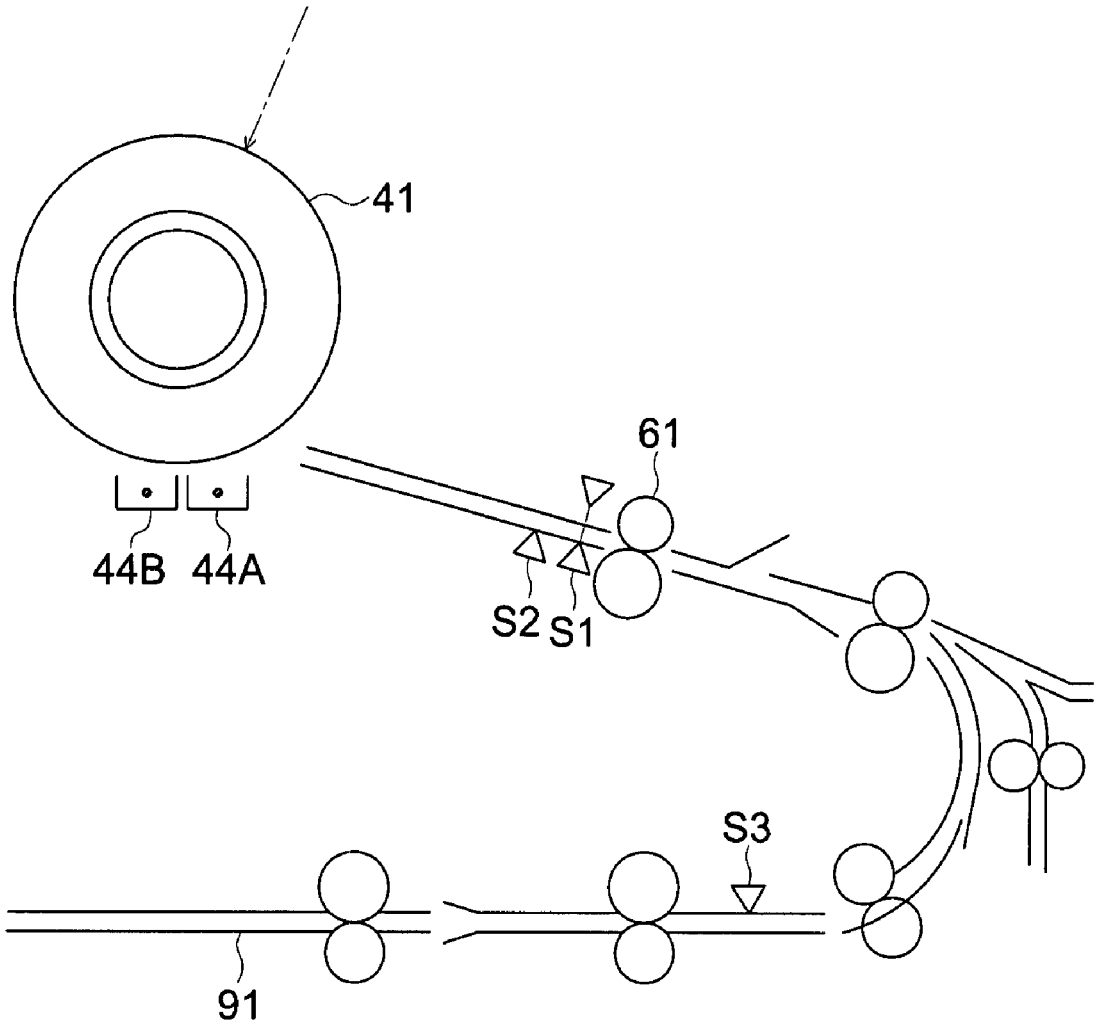
FIG. 2 is an enlarged view of a conveying path adjacent to a photoreceptor 41.

FIG. 2 is an enlarged view of a conveying path adjacent to a photoreceptor 41.

A sheet S conveyed from the sheet storing section 5 or a sheet S conveyed from the re-conveying section 9 is stopped at a registration roller 61 once, shown in FIG. 2, and then conveyed toward the photoreceptor 41 at a predetermined timing.

A sheet leading edge detection sensor SI that functions as an edge portion detection sensor in this embodiment is disposed on the conveying path, and detects an edge of a sheet S conveyed from the registration roller 61. For example, the sheet leading edge detection sensor S1 is constructed with a photosensor having a light emitting device and light receiving device. A sheet S passes between the light emitting device and light receiving device, and thereby an edge of the sheet S is detected.

A mark detection sensor S2 is disposed on the conveying path, and detects a reference mark formed on a sheet S. For example, the mark detection sensor may be a reflection type photosensor. Details of detection operation and the like will be described later.

When a detection signal is generated by the sheet leading edge detection sensor S1 or the mark detection sensor S2, exposure timing at the exposure section 3 is controlled, based on the signal, and an electrostatic latent image is formed at a predetermined position of the photoreceptor 41. As a result, an image on the front side and an image on the back side are formed at the same position from the same edge of the sheet S.

Although in the present embodiment, the sheet leading edge detection sensor S1 and the mark detection sensor S2 are implemented by separate sensors, it is possible to use a single sensor to function as both sensors.

A scale factor detection sensor S3 is disposed on a conveying path 91 in the re-conveying section 9. A reference mark formed on a sheet S, which has an image formed on which front side and has been conveyed, is detected by the scale factor detection sensor S3, and the position and scale factor of an image on the back side are adjusted, based on the detection result. The sheet S thermally shrinks in the fixing section, which causes the image on the front side to shrink. Therefore, the scale factor detection sensor S3 is necessary so as to make the scale factors of the image on the front side and the image on the back side be equal to each other.

Figure 3:
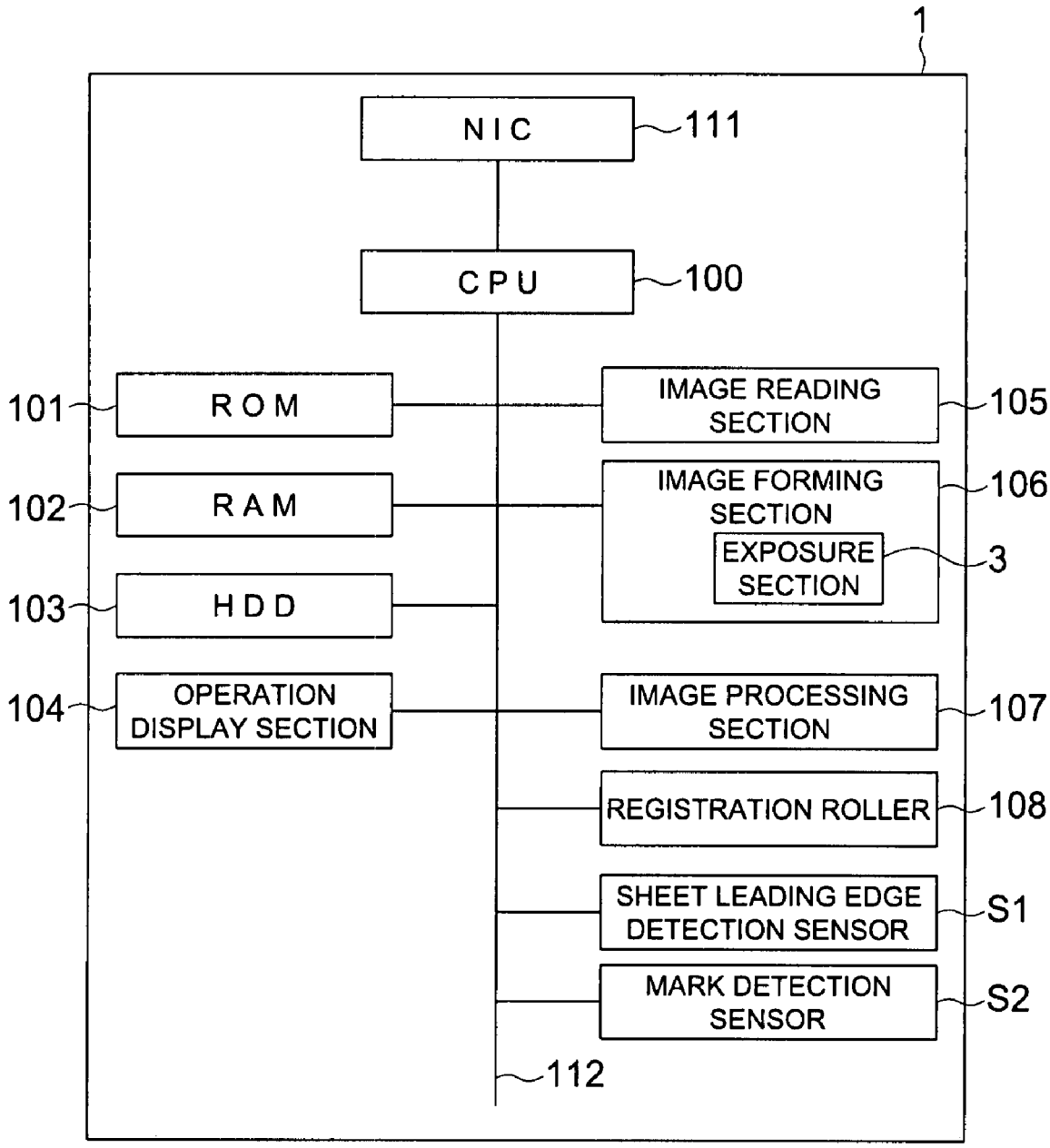
FIG. 3 is a block diagram related to the control structure of the image forming apparatus.

FIG. 3 is a block diagram related to a control structure of the image forming apparatus, showing a representative control structure.

A first determination section, second determination section, and CPU 100, which functions as a switching section, control the operation of the entire image forming apparatus, and are connected to a ROM (Read Only Memory) 101, RAM (Random Access Memory) 102, and so on, via a system bus 112. The CPU 100 reads various control programs stored in the RAM 101 and loads them on the RAM 102 to control operations of the respective sections. The CPU 100 executes various processings according to the programs loaded on the RAM 102, stores obtained processing results in the RAM 102 and displays them on an operation display section 104. Then, the CPU 100 saves the processing results stored in the REAM 102 at a predetermined storing destination.

The ROM 101 stores programs and data in advance, and is constructed with a magnetic or optical recording medium, or a semiconductor memory.

The RAM 102 forms a work area to temporarily store data processed by various control programs which are executed by the CPU 100, and the like.

A HDD 103 has functions, for example, to store image data of an image of an original document sheet having been read by the image reading section 105, and to store image data having been output. The HDD 103 has a structure with a number of metallic disks coated or deposited with a magnetic material. The disks are laminated at a uniform space and rotated by a motor at a high speed, and a magnetic head is put close to the disks to read and write data.

An operation display section 104, which functions as a setting section, enables various settings. The operation display section 104 is a touch panel type, for example, wherein the user inputs settings via the operation display section 104 so as to set conditions related to double-sided printing. Further, various kinds of information, such as information on network setting, is displayed on the operation display section 104.

The image reading section 105 optically reads the image of an original document sheet and converts it into an electrical signal, thereby generating image data. The generated image data is subjected to processing by an image processing section 107, and output to an image forming section 106.

The image forming section 106 performs image forming on a sheet S, based on image data subjected to processing by the image processing section 107. The image forming section 106 includes the exposure section 3 which writes image information onto the photoreceptor 41. Ina case of forming an image on the back side in double-sided printing, exposure timing at the exposure section 3 is controlled by the CPU 100, based on detection results by the sheet leading edge detection sensor S1 and the mark detection sensor S2. In other words, the CPU 100 determines the position of the image to be formed on the back side of the sheet, based on a predetermined control program.

A network interface card (NIC) 111 is an interface between a system bus 112 and an external network such as a LAN, and enables the image forming device 1 to communicate with an external terminal via the NIC 111.

Figure 4:
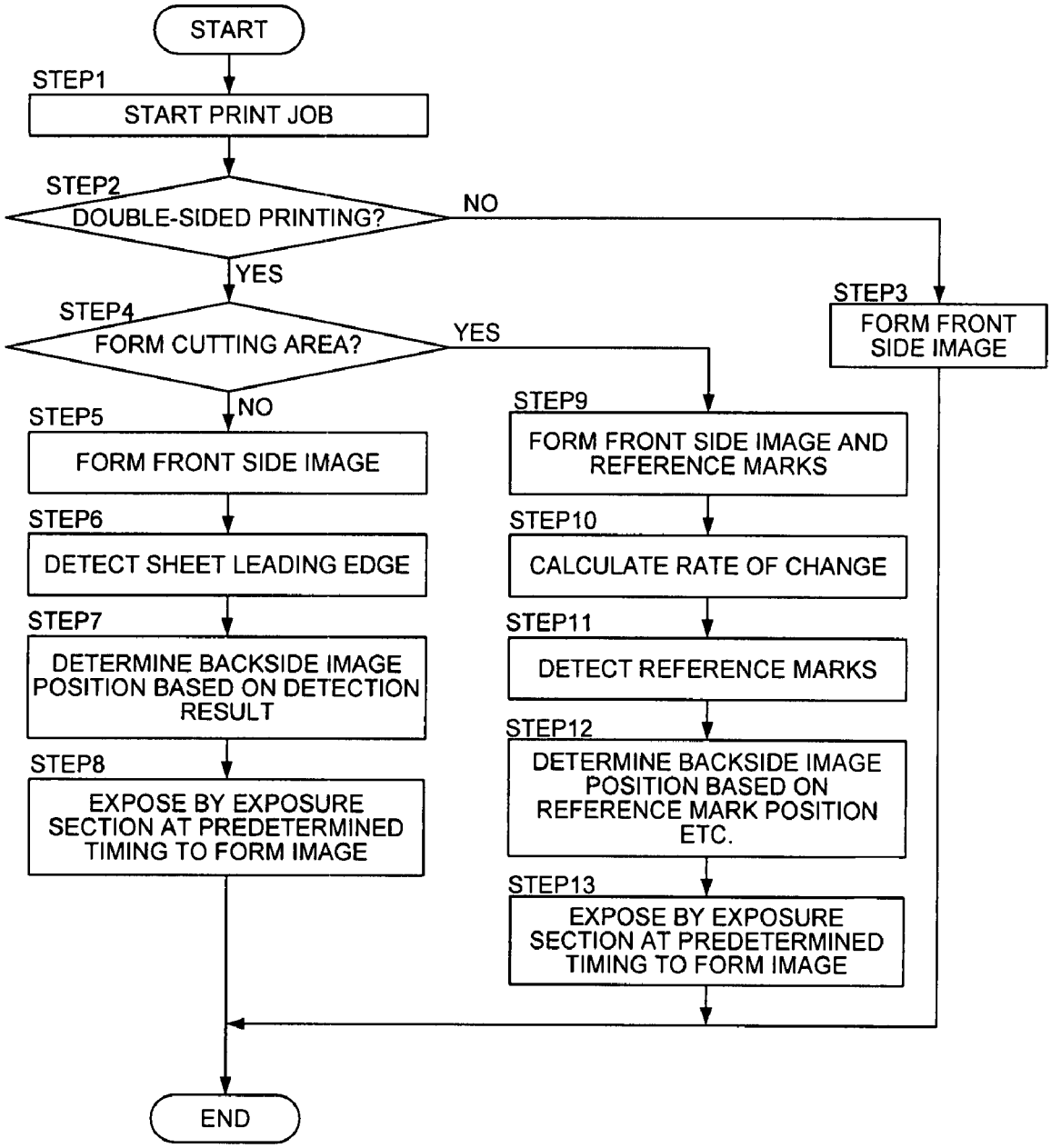
FIG. 4 is a flowchart related to operation for adjusting the position of an image on the back side.

FIG. 4 is a flowchart related to operation for adjusting the position of an image on the back side.

First, a print job is started to execute printing operation in the image forming device 1 (Step 1). A print job is a print instruction transmitted from a terminal connected with the image forming device 1, and may be a print instruction to be executed, for which the user sets printing conditions via the operation display section 104.

Next, the CPU 100 confirms setting information in the print job, and determines whether the printing operation to be executed is double-sided printing (Step 2). Setting information for double-sided printing can be information contained in a print job ticket, information having been set by the user via the operation display section 104, or the like. If the CPU 100 has determined that double-sided printing is not set, an image is formed on the front side of a sheet S (Step 3), the sheet S is ejected outside the apparatus without forming an image on the backside, and the job is completed.

If the CPU has determined that double-sided printing is set, the CPU 100 determines whether a cutting area is to be formed on a sheet S to be printed next (Step 4). For example, a cutting area is an area to be set so as to form a sheet in a special size by cutting a sheet in a large size. Setting information on double-sided printing contains information as to whether or not to form a cutting area on a sheet S, and accordingly, it is determined whether or not to form a cutting area, based on the setting information.

If a cutting area is not to be formed on a sheet S, an unnecessary area is not formed on the sheet S. Accordingly, it is not preferable that reference marks for superposing are formed on the sheet S. Therefore, in such a case where a cutting area is not to be formed on a sheet S, the position of an image on the back side is determined by detecting an edge of the sheet S and referring to it. This determination operation will be described, referring to the schematic diagram of FIGS. 5*a* to 5*c*.

Figure 5:
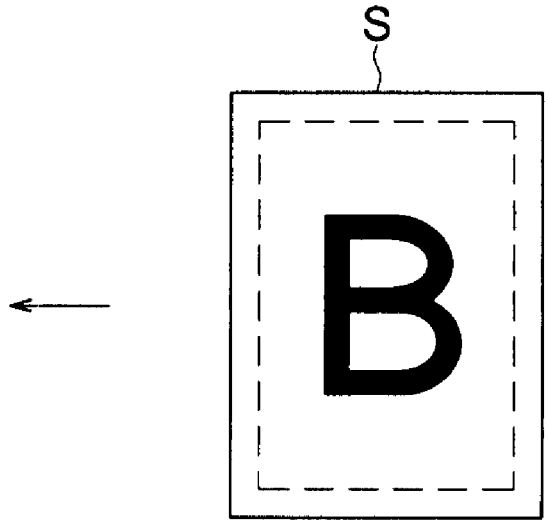
FIGS. 5*a* to 5*c* are diagrams illustrating operation for detecting the leading edge of a sheet S with a sheet leading edge detection sensor.
Figure 5:
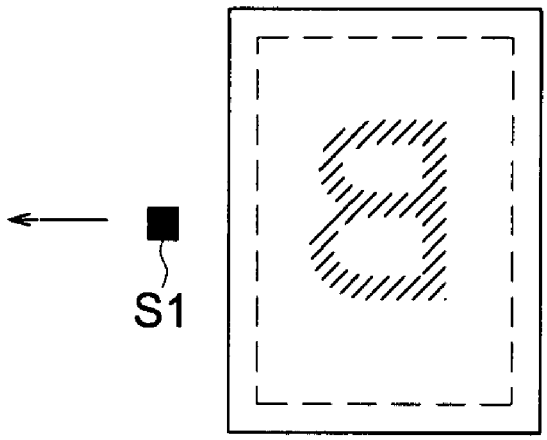
Figure 5:
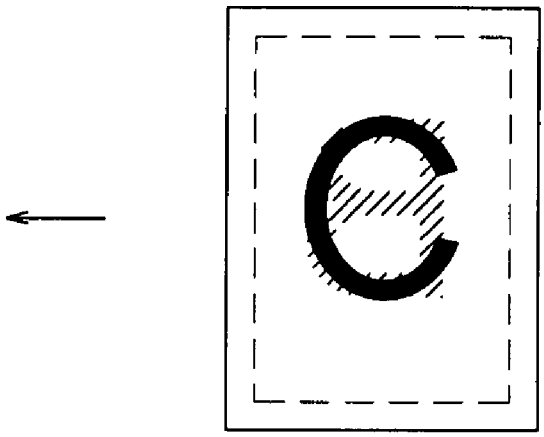

FIGS. 5*a* to 5*c* show a sheet S viewed in a direction perpendicular to the conveying direction and from above. As show in FIG. 5*a*, the sheet S on which front side an image (a character image "B" in FIG. 5*a*) has been formed is conveyed in the arrow direction.

When the image has been formed on the front side of the sheet S, the sheet S is switched back at the reversing section 92 (refer to FIG. 1) to be reversed front and back sides. The sheet having been reversed front and back sides is temporarily stopped by the registration roller 61, and then conveyed to the photoreceptor 41 at a predetermined timing. Herein, as shown in FIG. 5*b*, since the sheet leading edge detection sensor S1 is arranged in the direction of conveying the sheet S, the leading edge of the sheet S is detected when the sheet passes by the sheet leading edge detection sensor S1. Based on a result of the detection, exposure timing of the exposure section 3 is controlled such that an image on the back side is formed at a predetermined position from the leading edge of the sheet S. Thus, an image (a character image "C" in FIG. 5*c*) of the back side is formed on the sheet S.

This operation will be described, referring to the flowchart in FIG. 4. If a cutting area is not to be formed on a sheet S (Step 4; No), an image of the front side is formed (Step 5), and then the sheet leading edge detection sensor S1 detects the leading edge of the sheet S having been reversed (Step 6). Based on a result of the detection, the position of an image of the back side is determined (Step 7), and the image of the back side is formed by exposure by the exposure section 3 at a predetermined timing (Step 8).

If it has been determined that there is a cutting area on a sheet S, then reference marks corresponding to the position of the image on the front side are formed in the cutting area, and the position of the back side is determined, referring to the reference marks. Since the cutting area is an unnecessary area, the reference marks formed in this area do not cause inconvenience for the user. The operation of determining the position of the image of the back side with reference to the reference marks will be described, referring to the schematic diagrams in FIGS. 6*a* to 6*c*.

Figure 6:
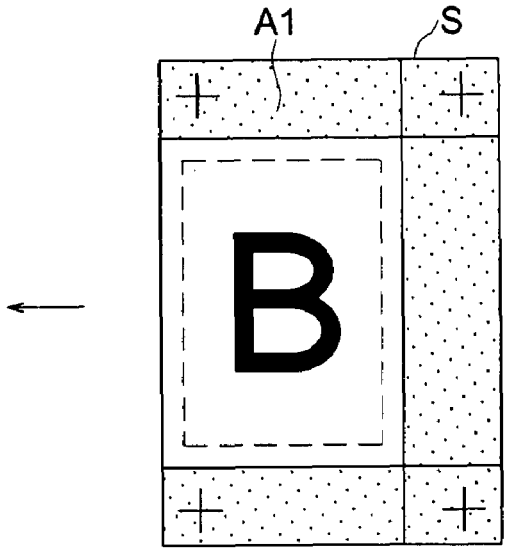
FIGS. 6*a* to 6*c* are diagrams illustrating operation of detecting reference marks formed on the sheet S with a mark detection sensor.
Figure 6:
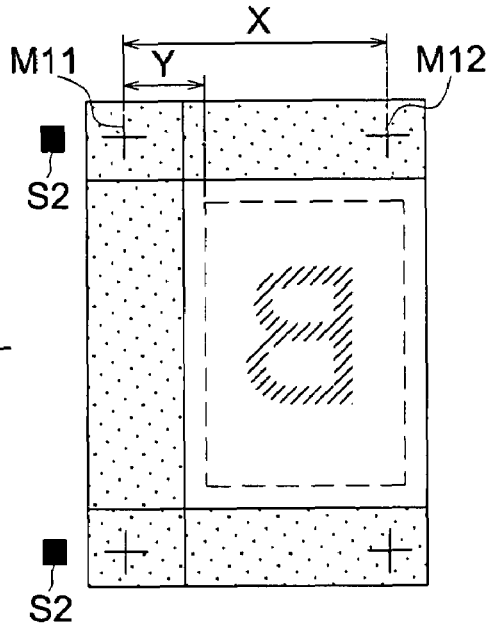
Figure 6:
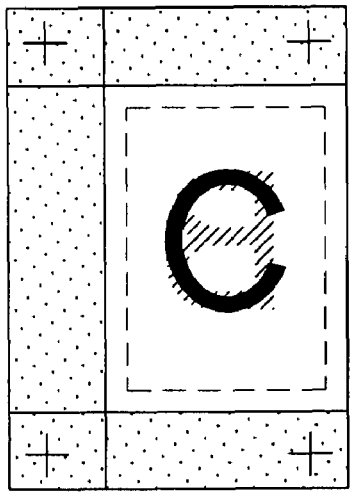

FIGS. 6*a* to 6*c* show a sheet S viewed in a direction perpendicular to the conveying direction and from above. As show in FIG. 6*a*, the sheet S on which front side an image (a character image "B" in FIG. 6*a*) has been formed is conveyed in the arrow direction.

A cutting area Al is formed on the sheet S. The cutting area A1 is cut, after printing operation is completed and the sheet S is ejected outside the apparatus. As shown in FIG. 6*b*, plural reference marks M11 and M12 are formed on the cutting area A1.

When the image of the front side has been formed, the sheet S is switched back and reversed front and back sides at the reversing section 92 (shown in FIG. 1).

When the reversed sheet S is conveyed toward the registration roller 61, the scale factor detection sensor S3 (shown in FIG. 2) detects the reference marks M11 and M12, and the CPU 100 calculates distance X between the reference marks M11 and M12. Distance X is calculated, according to the difference between the time of the detection of the reference mark M11 and that of the reference mark M12, and to the conveying speed of the sheet S. The sheet S on which front side the image has been formed thermally shrinks, when the sheet S passes the fixing device 7. Consequently, it is possible that the actual distance X between the reference marks N11 and M12 changes from that of the image data. Accordingly, it is necessary to determine the position of the image of the back side, taking into account the rate of change (the rate of a calculated distance X, with expected thermal shrinkage taken into account, to the distance between the reference marks M11 and M12 of the image data).

The sheet S is temporarily stopped by the registration roller 61, and then conveyed toward the photoreceptor 41 at a predetermined timing. Herein, as shown in FIG. 6*b*, since the mark detection sensors S2 are arranged in the conveying direction of the sheet S, the reference marks M1 are detected when the sheet S passes by the mark detection sensors S2. In a case where the position of the image of the back side is at a distance Y from the reference mark M11 according to image data, the exposure timing is adjusted such that forming of the image of the back side starts at a distance of Y multiplied by the rate of change by X. Thus, the image of the back side (the character image "C" in FIG. 6*c*) is formed on the sheet S at a position superposed with the position of the image of the front side.

Figure 7:
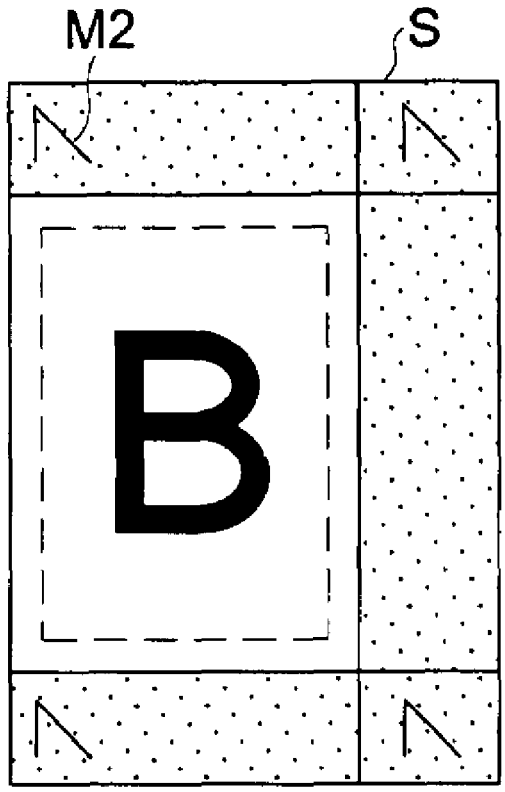
FIGS. 7*a* and 7*b* are diagrams illustrating other types of reference marks.
Figure 7:
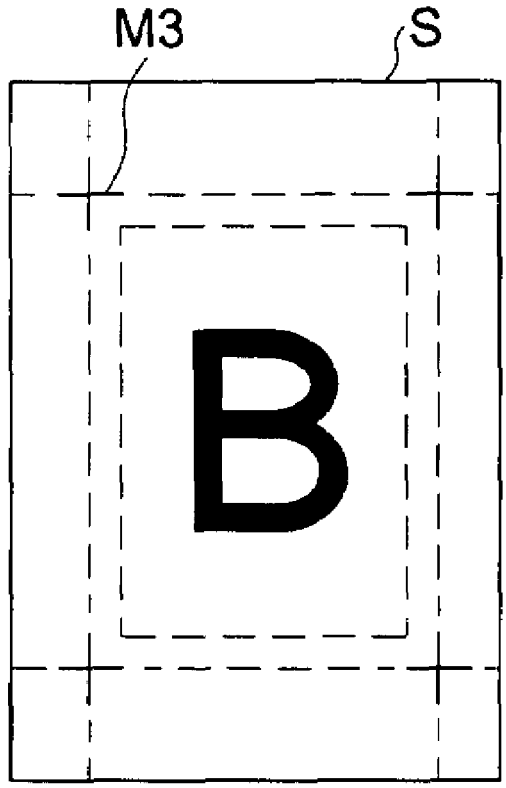
Figure 8:
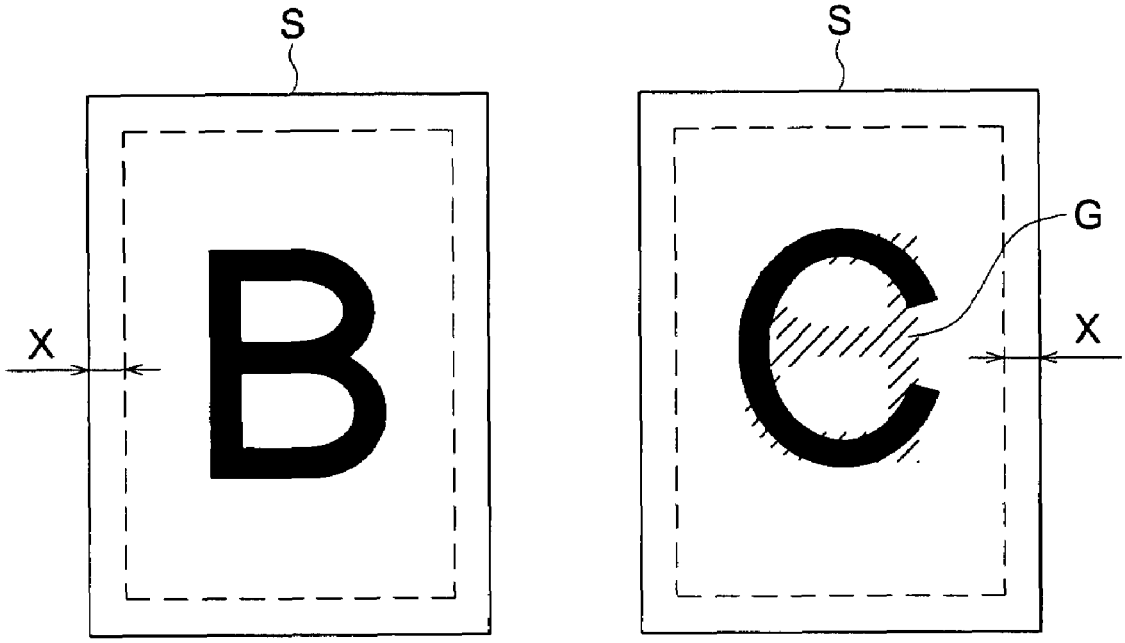
FIG. 8 is a diagram related to a sheet S having been subjected to double-sided printing.

Herein, the reference marks are not limited to "+" sown in FIGS. 6*a* to 6*c*, and may be, for example, marks "^", as shown in FIG. 7*a*, or may be cutting marks M3 "+" showing the boundaries of the cutting area, as shown in FIG 7*b*.

This operation described with reference to FIGS. 6*a* to 6*c* will be now described, referring to the flowchart in FIG. 4. If a cutting area is to be formed on a sheet S (Step 4; Yes), an image of the front side and reference marks are formed (Step 9), and then the rate of change in the distance between reference marks M11 and M12 is calculated (Step 10). Then, the mark detection sensors S2 detect reference marks of the sheet S (Step 11). Based on the rate of the change and the position of the reference marks, the position of an image of the back side is determined (Step 12). Then, the image of the back side is formed by exposure from the exposure section 3 at a predetermined timing (Step 13).

The CPU 100 reads a control program stored in the ROM 101 and loads the program onto the RAM 102 to execute the operation in accordance with this flowchart. The CPU 100 switches as to which method is to be applied for determination of the position of the image to be formed on the back side.

As has been described above, the method for determination of the position of an image of the back side is switched, based on setting information on double-sided printing, specifically, information as to whether a cutting area is to be formed on a sheet S. Superposing between the images of the front side and back side is executed, switching two types of methods. Thus, unnecessary images are not formed in the image area of the sheet, and it is possible to perform superposing by a suitable method, based on setting information on double-sided printing. Further, image forming operation can be executed, with effective use of information as to whether a cutting area is to be formed on the sheet in superposing images of the front side and back side.

It is to be expressly understood that the present invention is not restricted to the embodiment described above. The invention is not limited thereto, and various modifications and additions can be made within the scope and spirit of the invention.

What is claimed is:

1. An image forming apparatus that forms an image on a front side of a sheet then reverses the sheet front and back sides and forms an image on the back side of the sheet, comprising:

a conveying path which conveys the sheet;

an edge portion detection sensor which detects an edge of the sheet being conveyed, the sensor provided on the conveying path;

a mark detection sensor which detects a reference mark formed on the sheet being conveyed, the sensor provided on the conveying path;

a first determination section which determines a position of an image to be formed on the back side of the sheet, referring to the edge of the sheet detected by the edge portion detection sensor;

a second determination section which determines a position of an image to be formed on the back side of the sheet, referring to the reference mark detected by the mark detection sensor; and a switching section for switching whether to use the first determination section or the second determination section for determination of the position of the image to be formed on the back side of the sheet, based on setting information on double-sided printing to be performed by the image forming apparatus.

2. The image forming apparatus of claim 1, wherein the setting information comprises information whether or not to form a cutting area on the sheet.

3. The image forming apparatus of claim 1, wherein the setting information is contained in a print job ticket.

4. The image forming apparatus of claim 1, further comprising a setting section for setting a condition related to double-sided printing to be performed by the image forming apparatus, wherein the setting information is set via the setting section.

5. The image forming apparatus of claim 1, wherein the reference mark is formed on a cutting area on the sheet.

6. The image forming apparatus of claim 1, wherein the edge portion detection sensor is provided separately from the mark detection sensor.

* * * * *